US010870310B2

(12) United States Patent
Lehmann

(10) Patent No.: US 10,870,310 B2
(45) Date of Patent: Dec. 22, 2020

(54) PACKING POCKET

(71) Applicant: Kern AG, Konolfingen (CH)

(72) Inventor: Urs Lehmann, Grosshochstetten (CH)

(73) Assignee: KERN AG, Konolfingen (CH)

( * ) Notice: Subject to any disclaimer, the term of this patent is extended or adjusted under 35 U.S.C. 154(b) by 403 days.

(21) Appl. No.: 15/506,374

(22) PCT Filed: Aug. 7, 2015

(86) PCT No.: PCT/EP2015/068223
§ 371 (c)(1),
(2) Date: Feb. 24, 2017

(87) PCT Pub. No.: WO2016/030167
PCT Pub. Date: Mar. 3, 2016

(65) Prior Publication Data

US 2017/0253073 A1 Sep. 7, 2017

(30) Foreign Application Priority Data

Aug. 28, 2014 (CH) ..... 1302/14

(51) Int. Cl.
*B65B 43/26* (2006.01)
*B43M 3/04* (2006.01)

(52) U.S. Cl.
CPC ..... *B43M 3/045* (2013.01)

(58) Field of Classification Search
None
See application file for complete search history.

(56) References Cited

U.S. PATENT DOCUMENTS 4,020,615 A 5/1977 Irvine
5,125,215 A 6/1992 Orsinger
5,168,689 A * 12/1992 Macelis ..... B43M 3/045 53/284.3
5,191,751 A 3/1993 Marzullo
(Continued)

FOREIGN PATENT DOCUMENTS

EP 0 504 114 B1 9/1992
EP 2 261 055 B1 12/2010
EP 2 756 964 B1 7/2014

OTHER PUBLICATIONS

International Search Report for PCT/EP2015/068223 dated Oct. 9, 2015.

*Primary Examiner* — Michelle Lopez
*Assistant Examiner* — Chinyere J Rushing-Tucker
(74) *Attorney, Agent, or Firm* — Pearne & Gordon LLP

(57) ABSTRACT

A packing pocket for a device for inserting material into envelopes for sliding the envelope contents into an envelope. The packing pocket includes a mid-line (M) in relation to a transport direction of the envelope, as well as a number of slats which are parallel to the mid-line (M), and which are arranged on a plane (K) together with a flap guide. The slats are mounted on the device for inserting material into envelopes, on a mounting rail or on an adjustment rail. One or more slats are associated with a sheet guide arranged at a distance from the flap guide. In addition, the sheet guide is arranged in a spring-like manner in relation to the flap guide in a region of the packing pocket that is upstream of the envelope supply.

20 Claims, 4 Drawing Sheets

(56) References Cited

U.S. PATENT DOCUMENTS

| | | | | | |
|---|---|---|---|---|---|
| 5,251,425 | A * | 10/1993 | Kern | B65H 3/26 | 53/381.7 |
| 5,642,598 | A * | 7/1997 | Cannaverde | B43M 3/045 | 53/284.3 |
| 5,890,280 | A * | 4/1999 | Matsuzawa | H01R 43/052 | 29/33 M |
| 5,992,132 | A * | 11/1999 | Auerbach | B43M 3/045 | 493/259 |
| 2002/0112453 | A1* | 8/2002 | Rivenbark | B43M 3/04 | 53/460 |
| 2003/0022780 | A1* | 1/2003 | Ifkovits | B43M 3/04 | 493/419 |
| 2004/0250517 | A1* | 12/2004 | Hsieh | B43M 3/045 | 53/569 |
| 2006/0042196 | A1* | 3/2006 | Stemmle | B43M 3/045 | 53/492 |
| 2010/0313530 | A1* | 12/2010 | Smith | B43M 3/045 | 53/569 |
| 2011/0099946 | A1* | 5/2011 | Fijnvandraat | B43M 3/045 | 53/381.5 |
| 2013/0055686 | A1* | 3/2013 | Batzer | B43M 3/04 | 53/473 |
| 2013/0333330 | A1* | 12/2013 | Batzer | B43M 3/045 | 53/460 |
| 2013/0333333 | A1* | 12/2013 | Batzer | B43M 3/04 | 53/473 |

* cited by examiner

PACKING POCKET

The present invention relates to a packing pocket for an inserting system, comprising a plurality of slats and a sheet guide, and to a method for filling the packing pocket.

EP 0 504 114 B1 discloses an inserting system which can more or less double the speed in comparison to the prior art known at that time. In said document, a rotatably mounted packing pocket and a holding-down roller are controlled via levers by a cam. The large number of rapidly moving parts required for this is expensive to manufacture and, on account of the relatively large moving mass, hinders any further increased packing output. In addition, the moving packing pocket leads to undesirable vibrations which likewise limit the packing output. Furthermore, in such a system, in order to ensure optimal guidance of the envelope and of the envelope contents to be guided through the packing pocket, a different packing pocket has to be installed for each envelope size that differs in terms of width, that is to say the dimension transverse to the transport direction of the envelope, which packing pocket is moreover suitable only for a very limited range of thickness of the contents to be packed. Such a changeover is difficult due to the movable guidance of the packing pocket.

EP 2 756 964 A1 discloses an inserting system in which an envelope is pulled onto guide blades, which each have a strip rising initially upward from the free end, and is filled. In said system, however, the envelope and the envelope contents already touch one another during the insertion of the contents. If the contents differ from a conventional sheet shape, or if the sheet or/and envelope is distorted, the envelope or the contents may become damaged.

It is an object of the present invention to avoid the disadvantages of the prior art and to provide a packing pocket by which the packing speed on different inserting systems can be further increased, for example to 30,000 to 40,000 packing operations per hour. In addition, it is an object of the invention to provide a packing pocket which does not have to be moved during the inserting operation, in order to avoid disruptive vibrations. Finally, it is also an object of the invention to provide a packing pocket for different envelope blanks and/or envelope contents. In addition, the intention is also for it to be possible to process reliably even envelopes which have become warped due to a reduced quality or poor storage, which is not possible in the prior art.

A packing pocket which achieves the stated objects and avoids the disadvantages of the prior art is disclosed in claim 1, and a corresponding method is disclosed in claim 13. Further preferred embodiments can be found in the dependent claims.

A packing pocket according to the invention is suitable for an inserting system which is designed for inserting envelope contents into an envelope and which comprises for example a holder for empty envelopes, a flap opener for opening the envelope flaps, transport elements for transporting the envelopes from the holder to the packing pocket on which the envelopes are filled, a supply device for supplying the envelope contents to and into the packing pocket, and onward transport elements for the onward conveying of the filled envelope. Such an inserting system may be constructed as one machine or from a plurality of separate modules which cooperate with one another in the described manner only after being fully assembled.

The packing pocket has, in relation to a transport direction of the envelopes, a mid-line M in a flap guide plane K, and also a plurality of slats which are parallel to the mid-line M and which are arranged with the respective flap guide in the flap guide plane K. Thereby, the side of the flap guide is preferably selected to be substantially horizontal, whereby the plane K is preferably substantially identical to the horizontal plane.

At least one or more slats is assigned a sheet guide which is at a distance from the respective flap guide. For better guidance of envelope contents of different thickness, the sheet guide is designed to be flexible relative to the flap guide, or relative to the plane K, at least in a front region of the packing pocket, said front region being at the front relative to the supply of envelopes, or else for the entire sheet guide. This arrangement also defines the packing space, in which the envelope contents are guided in such a way that they do not touch the envelope.

The spring action of the sheet guide will in this case advantageously be adjusted such that a speed of supply of the envelope contents is substantially maintained for envelope contents of different thickness.

If the sheet guide itself is a spring, it will preferably be designed to be flexible vertically relative to the flap guide, or relative to the plane K, with a deviation of up to 10°. For example, a sheet guide made of flexible material may in the rear region be fixedly connected to a slat or to a mounting rail and then extend in a finger-like manner into the front region of the flap guide, in particular as far as the free front edge of one or more slats, in a manner directed at an angle, in particular at a flat angle, for example between 0° and 20°, preferably less than or equal to 10°, relative to the flap guide. During the insertion of the envelope contents, which may additionally be assisted by an angled plane on the sheet guide and/or slat, the envelope contents are supported by the finger-like spring of the sheet guide, thereby preventing any premature touching of the envelope. As a result, it is also possible to use and to reliably process envelopes of poorer quality, such as for example the aforementioned warped or otherwise distorted envelopes.

In addition, in the case of thick envelope contents, said spring prevents the envelope from being pushed out prematurely. As a result, the mechanical stress on the open envelope during the insertion of the envelope contents can be lowered and excessive deformation or even tearing can be avoided.

The sheet guide may be designed in such a way that it touches the inner side of the flap guide in the front region of the slat, in particular in the immediate region of or at the front edge of the packing pocket.

Further alternatives, such as for example a sheet guide that is itself biased by one or more springs, a sheet guide biased by sprung hinges, etc., can also be used.

Due to the spring effect, the envelope is tensioned so that on the one hand envelope contents of different thickness can be processed and on the other hand the envelope is held back or slowed so that the contents are conveyed onward with the envelope only after the insertion operation is complete, and the envelope is not already pushed away from the packing pocket during the insertion operation.

The slats are preferably arranged separately from one another on the inserting system or on a mounting rail, wherein additionally means are provided for displacing the outer (with respect to the mid-line M) side slats, including the sheet guides assigned thereto, in order to displace these in parallel toward or away from one another substantially perpendicular to the mid-line M. Particularly for processing wider envelope formats or envelope content formats, it is advantageous if at least one inner slat is provided in a stationary manner between the outer slats. These outer slats, also known as side slats, may be designed as a bracket or at least partially as a U-shaped profile with an outwardly directed base, so that the envelope contents are protected or/and guided on both sides by the U-shaped profile.

The adjusting means for displacing the side slats may comprise electrical or mechanical means, preferably an adjusting spindle. In order to guide the envelope contents, the outer slats are advantageously closed on the respective outer side surface. In contrast, the two side surfaces of the at least one inner slat are open.

In other embodiments, at least the two outer slats are each assigned a sheet guide. Alternatively, at least one inner slat, preferably at least one central slat or respectively all slats, are assigned a sheet guide. In an embodiment with a sheet guide assigned to the central slat, said sheet guide may be designed to extend laterally beyond the mid-line M into the region of adjacent slats or/and into the region of the outer slats.

In a method according to the invention for filling a packing pocket, in particular a packing pocket as described above, an envelope with an open envelope flap is transported forward to the packing pocket and envelope contents are supplied to the packing pocket by means of a supply device. The filled envelope is then conveyed onward by onward transport elements.

In said method, the envelopes are first aligned in the direction of the packing pocket, for example by means of a movable holding-down roller or a funnel-like arrangement for guiding the envelopes.

When the envelope is subsequently pulled onto the packing pocket, it is first pushed onto the packing pocket by the transport roller and counter-roller and preferably, in order to prevent buckling, at the latest at the time at which the rear edge of the envelope is no longer in engagement between the transport roller and the counter-roller, is pulled onto the packing pocket by one or more pulling rollers until the envelope bottom arrives at the front edge of the packing pocket.

In order to additionally assist the opening of the envelope and thus to facilitate the pulling thereof onto the packing pocket, cones which are preferably adjustable and which laterally delimit the flap guide plane may be provided between the transport means directly adjacent to the packing pocket, for example a transport roller or a funnel, and a pulling means, for example a pulling roller.

The envelopes may be supplied from above or from below. A transport angle (Wt) between the supplied envelope and the flap guide can also be varied during the pulling of the envelope onto the packing pocket, in order to facilitate opening of the envelope.

For supplying the envelope contents, the supply device may comprise fingers attached to toothed belts or drive belts or to chains. Said fingers may be guided for example through slots in the packing pocket from one side to protrude beyond the other side of the supply plane. Alternatively, the transport fingers may also be guided between the slats, as described above, of a segmented packing pocket.

During the filling operation, which advantageously is started at the same time as the envelope is pushed on, the envelope contents are guided into the packing pocket, said packing pocket comprising a plurality of slats which are parallel to the mid-line M and which are arranged with a flap guide in a plane K. The envelope contents are spring-biased toward the flap guide by a sheet guide, at least in a front region in relation to the envelope supply, so that the envelope contents do not touch the envelope until in the region of a front edge of the packing pocket.

Advantageously, the envelope contents are biased here at least by two sheet guides assigned to respective outer slats. In addition or as an alternative, the biasing may take place solely by one sheet guide assigned to an inner slat. Said sheet guide may, particularly if it is the only sheet guide of the packing pocket, also be wider than the associated slat, for example the central slat.

Furthermore, the envelope contents may additionally be guided by closed outer side surfaces of the outer slats, said slats being designed for example at least partially as a U-shaped profile.

Provided downstream of the packing pocket in the onward transport direction of the envelope are onward transport elements, for example onward transport rollers and one or more segments, for conveying the filled envelope onward away from the packing pocket. The onward transport angle (Wa) from the front edge of the packing pocket is advantageously flat and directed downward in order to prevent the envelope contents from slipping out during the onward transport.

In a further method according to the invention for filling a packing pocket, firstly in a known manner for example, from a stack of envelopes stored in a holder, the flap of the envelope located closest to an envelope removal opening of the envelope holder is opened by a flap opener. The envelope is then transported by transport elements from the holder to a packing pocket, on which the envelopes are filled. The envelope contents are supplied to the packing pocket by means of a supply device and then the filled envelope is conveyed onward by onward transport elements.

The envelopes are aligned for example by a movable holding-down roller or a funnel-like arrangement for guiding the envelopes in the direction of the packing pocket. At the same time, the envelope is at least partially, but preferably completely, pulled onto the packing pocket by at least one pulling means, for example a pulling roller, wherein the pulling means, for example the pulling roller(s), cooperates at least temporarily, for example periodically, with the packing pocket. In addition, means for synchronizing the movement of the holding-down roller or of the funnel with the pulling means are used, which synchronizing means move these from a first position for receipt of the envelope flap by the funnel into a second position after the envelope flap has been placed onto the flap guide. As a result, a transport angle (Wt) between the supplied envelope and the flap guide is varied during the pulling of the envelope onto the packing pocket, in order to facilitate opening of the envelope.

The envelopes are then transported onward, for example as mentioned above.

The principle of the present invention as well as various examples of possible embodiments will be discussed below with reference to the figures.

Figure 1:
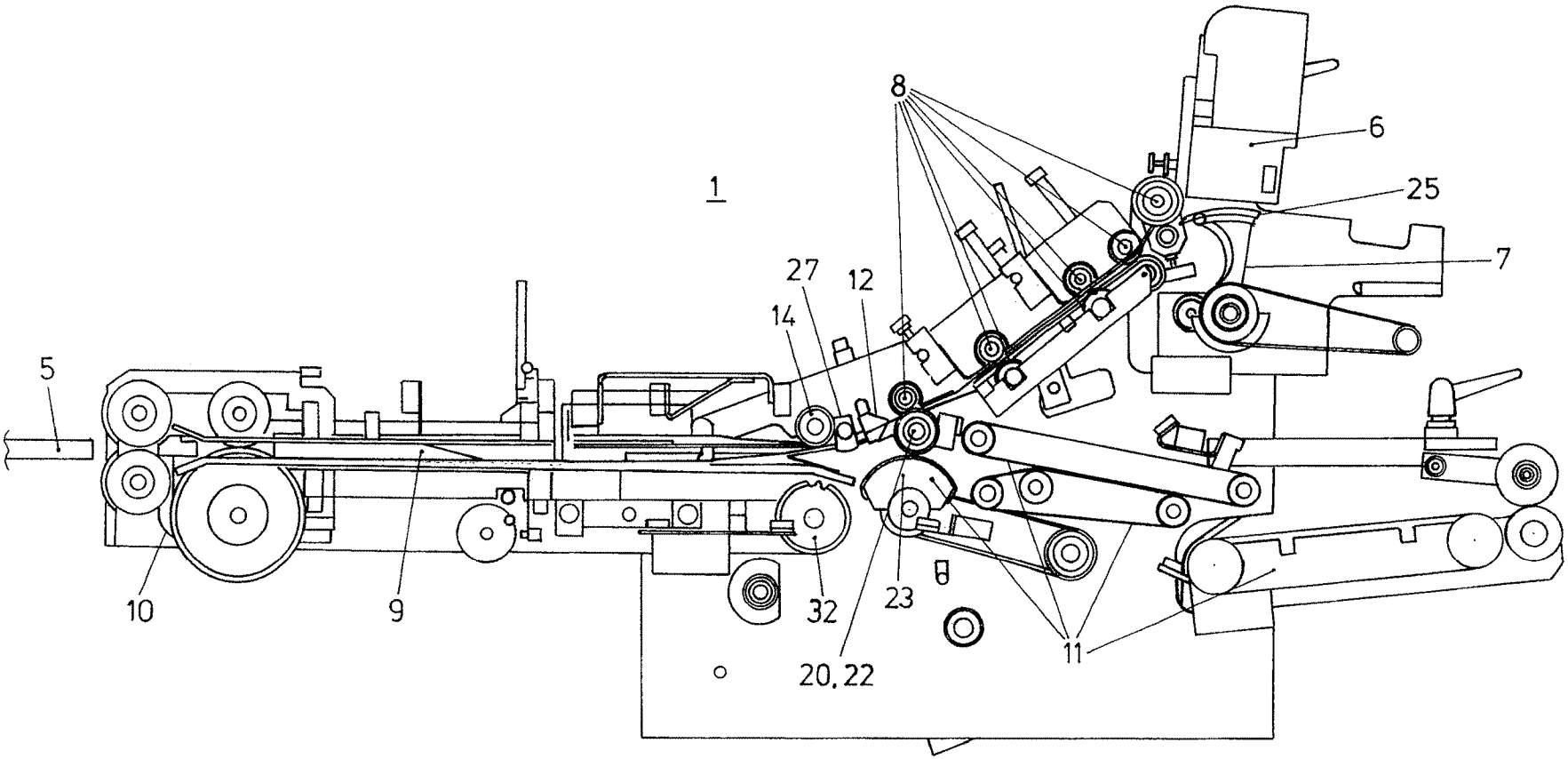
FIG. 1 shows a diagram of an inserting system having a packing pocket.

FIG. 1 shows a diagram of an inserting device with envelopes being supplied from above. The envelopes, which are stored in a holder 6 for empty envelopes with the flap downward in the transport direction, are transported, after being opened by a flap opener 7 which comprises for example an opener claw 25, with the opened flap at the front by at least one transport element 8 in the direction of the packing pocket 9. For pulling onto the packing pocket, the envelope 2 is aligned with the packing pocket 9 by the funnel 12. The funnel 12 and the opening cones 27 help during the opening of the envelope 2 in order to pull the latter more easily onto the packing pocket. Once the envelope has been pulled on, said envelope is filled with the envelope contents 5 which are supplied via the supply device 10. Then, preferably without interrupting the movement of the envelope contents 5, the envelope is transferred by at least one insertion finger 26, which guides the envelope and the contents into the region of the funnel, to the onward transport elements 11 and is transported away.

Figure 2:
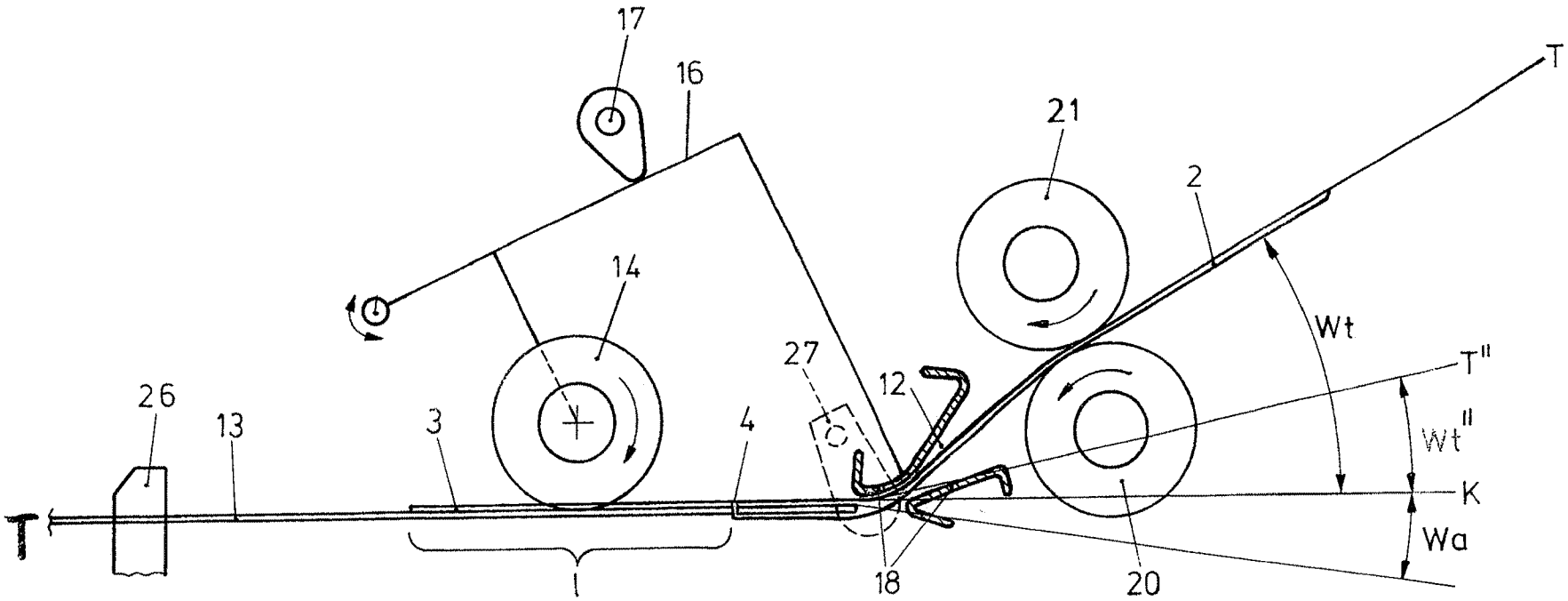
FIG. 2 shows a schematic diagram of the pulling of an envelope onto the packing pocket.

FIG. 2 shows a functional diagram of the envelope being pulled on, using the example of an inserting system supplying from above. Once the envelope 2 has been supplied, with the envelope flap 3 at the front, between a pair of rollers rotating in opposite directions, here a driven transport roller 20 and the counter-roller 21, which is biased against the transport roller 20, to the flap guide side of the packing pocket 9 through a funnel 12 at a transport angle (Wt), the flap side of the envelope is pushed further onto the flap guide until it is gripped, in the manner shown, by a, in the present case, lowerable pulling roller 14 and is pulled onto the packing pocket. During this, the transport angle Wt and the transport plane T can be shifted by moving the funnel in the direction of the plane K, for example as shown at Wt" or WT and T".

Figure 3:
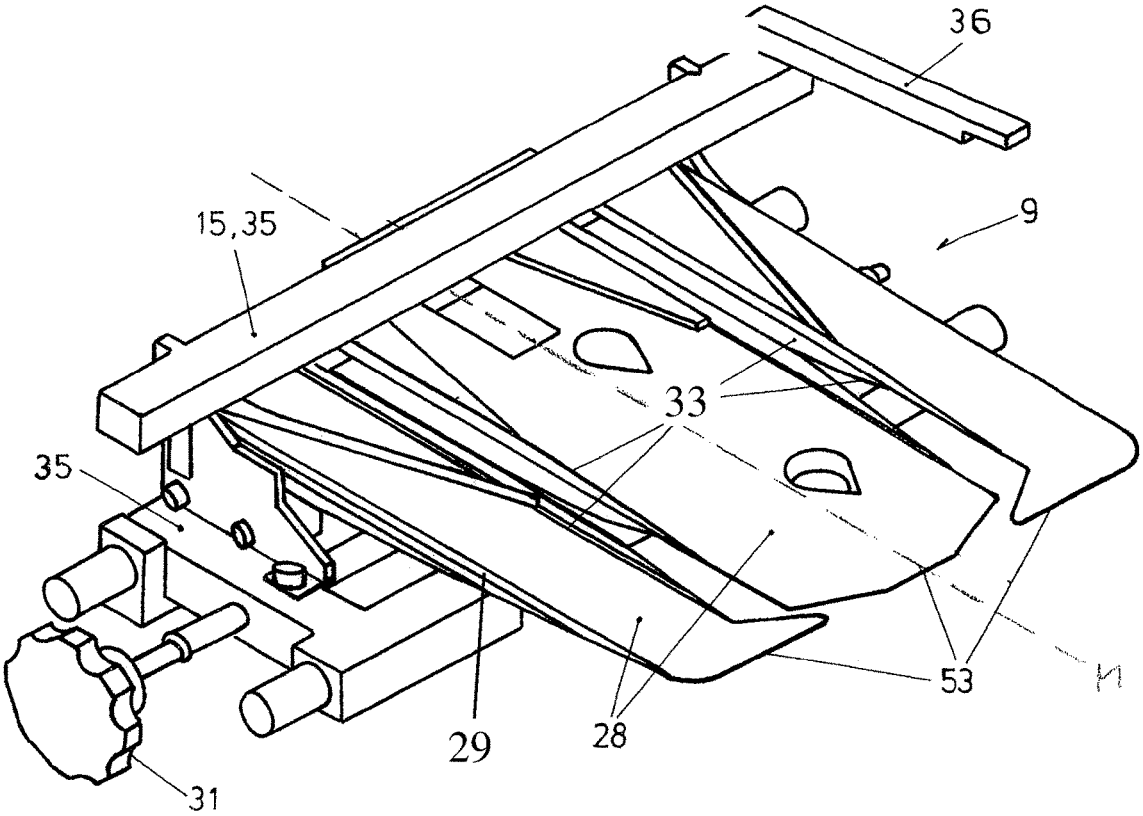
FIG. 3 shows a 3D view of a packing pocket.

If the flap guide side of the flap guide is completely planar, it is completely included by the plane K. Usually, however, the surface of the flap guide side is also formed by ribs or other elements on the spaced-apart slats. These elements may also pass through the plane K. By way of example, ribs 33 which rise at an angle toward the rear at least in a partial region and which are intended to lift the front edge of the envelope flap and thus the entire flap, so that the finger of the supply device can pass through below the latter while itself extending over the flap guide plane K of the packing pocket, may be provided on the packing pocket in a region in the vicinity of or at the front edge of the packing pocket, as shown in FIG. 3. The finger in this case protrudes upward just out of the packing pocket plane so that no document is lost in the packing pocket. In this case, the flap guide side and the plane K are preferably oriented substantially horizontally.

By moving the funnel 12 as the envelope passes through, easy opening of the envelope 2 is made possible, and this can be further assisted by cones 27, shown here in dashed line, which are mounted in a region to the side of the front edge of the packing pocket. Advantageously, the movement of the funnel from a first position to a second position will be completed immediately before or during the placement of the flap tip onto the flap guide side, until the foremost edge of the packing pocket 9 has been passed by the flap fold 4, that is to say in the region of approximately one flap length l.

During the pulling-on of the envelope 2, for example by means of pulling rollers 14 which are lowered in synchronism with the movement of the envelope, the envelope contents 5 are pushed through the packing pocket 9 into the envelope 2 by the supply device 10, which comprises for example at least one finger 26, which is attached to a toothed belt or a chain, and a supply drive 32. The substantially closed design of the packing pocket according to the invention prevents the envelope contents 5 from touching the envelope 2 during this. Only when the envelope bottom arrives in the region of the front edge of the packing pocket does contact occur for the first time between the envelope contents and the envelope, whereby the envelope contents push the envelope away from the packing pocket. Then, after the pulling roller 14 has been raised away from the envelope that has been pulled on and then packed, the envelope is moved by the finger 26 in the direction of the onward transport elements, for example the segment 23 which cooperates with the transport roller 20 and/or a separate onward transport roller 22.

Alternatively, the pulling roller 14 may also first be operated in the onward transport direction opposite to the pulling-on direction, in order to accelerate the envelope to the speed of the continuously supplied envelope contents, as a result of which for example even particularly thin or delicate envelopes can be filled without reducing the speed of the envelope contents passing through into the packing pocket or without having to slow said contents too greatly or at all. By means of the onward transport elements 11, 20, 23, the envelope is preferably conveyed onward at a downwardly directed flat onward transport angle Wa in order to avoid any slipping-out or sliding of the envelope contents 5.

Such a downwardly directed onward transport angle is also advantageous in the case of an inserting system supplied with envelopes from below, in which the packing pocket 9 is mounted inversely, that is to say with the outer flap guide side of the flap guide 13 directed downward. The envelope can then likewise be supplied the other way round (flap downward).

FIG. 3 shows an adjustable packing pocket according to the invention, which can be used with very different inserting systems if these are to be configured in a flexible manner with regard to the envelope blanks and with regard to the packing size, in particular with regard to the thickness of the envelope contents. According to the exemplary embodiment shown therein, three so-called slats 28 are mounted on or below a mounting rail 15, here preferably an adjustment rail 35. While the (in this case one) inner slat 28" is attached in a stationary manner to the mounting rail or adjustment rail, the outer slats 28' can be moved transversely to the transport direction or onward transport direction in order thus to be able to set the packing pocket 9 in an optimal manner to different envelope widths. In the present example, the setting of the width is carried out by way of a manually operated adjusting spindle 31, but this can also be provided in an automatic manner, for example in an electrically driven manner. For flexibly attaching such a packing pocket 9 to the inserting system 1, a mounting stop 36 is provided here.

Figure 4:
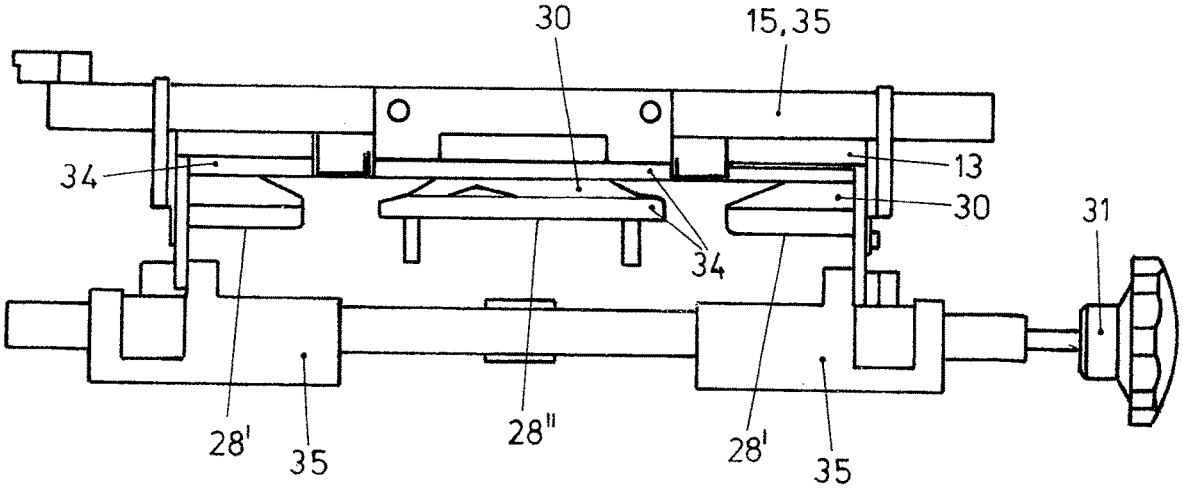
FIG. 4 shows a rear view of a packing pocket.

FIG. 4 shows a rear view of the packing pocket 9 shown in FIG. 3. Here, it is additionally also possible to see auxiliary surfaces 34 which are arranged upstream of the inner guide surfaces of the individual slats in the direction of supply of the envelope contents, so as to enable easier insertion of the contents into the packing pocket 9. In order to ensure that the envelope 2 is pulled onto the packing pocket 9 as reliably as possible, the side slats 28' as shown in FIG. 3 may be designed to project inward, toward the stationary inner slat or the mid-line M, in the region of the free front edge 53 facing toward the transport plane or onward transport plane. The outer side surfaces of the slats 28' are at least partially closed in order to laterally guide the envelope contents 5 and prevent the envelope contents from touching the envelope before the insertion operation is complete.

Figure 5:
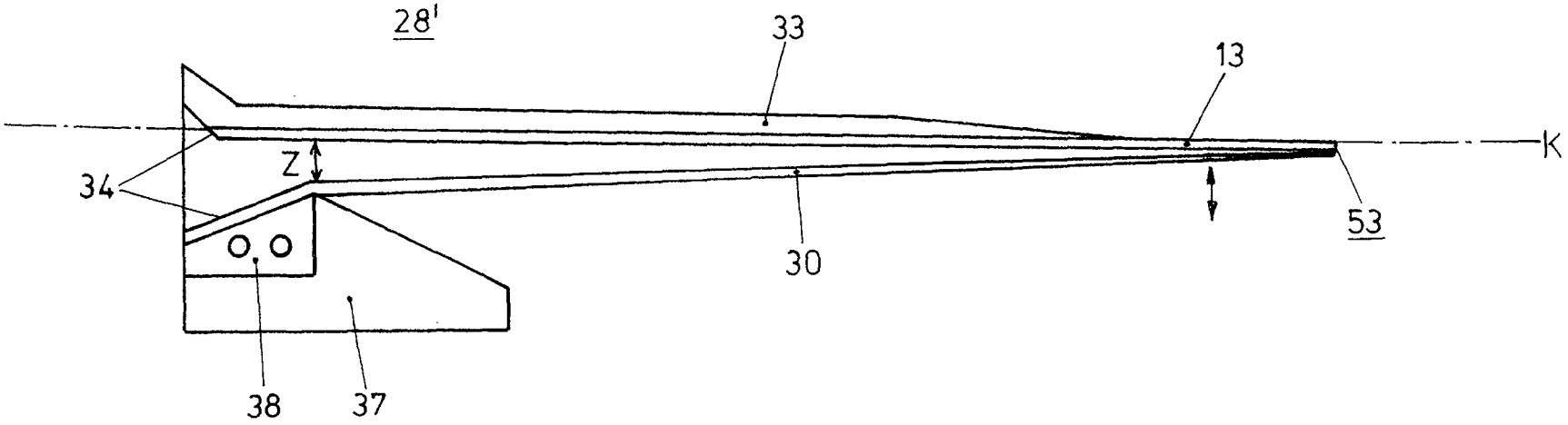
FIG. 5 shows a slat.

FIG. 5 shows by way of example the side view of an outer slat 28' as seen from the inside. The flap guide 13, as shown here at the top, and the sheet guide 30, shown at the bottom, are both provided with an auxiliary surface 34 in the direction of the supply device 10. The side slat 28' comprises a slat base 37, which can be produced for example as a one-piece bracket with the flap guide 13, in order to increase the stability of the packing pocket.

At the slat base 37, the sheet guide 30 may be attached in the rear region to a spring stop 38. The sheet guide 30, which is made of a flexible material, is inclined at an angle relative to the inner surface of the flap guide, so that in the front region it ends in the direct vicinity of the flap guide or even bears against the latter. Only by inserting the envelope contents is the sheet guide 30 pressed downward and exposes the route into the envelope or in the onward transport direction. As a result, even envelope contents which differ in terms of their thickness can be reliably supplied at the same speed. The maximum thickness of the envelope contents is defined in this case by a distance z, in the rear region, between the inner guide surfaces of the flap guide 13 and of the sheet guides 30.

Alternatively, the slat 28' may be designed at least partially as a U-shaped profile with an outwardly directed base, so that the envelope contents are guided and/or supported by the outer slats through the U-shaped profile. The lower part of the U-shaped profile here may be designed for example as a sprung hinge which raises the envelope contents toward the flap guide.

The design of an inner slat 28" may be selected to be similar to that of the outer slat 28', wherein here advantageously the sheet guide 30 and the flap guide 13 are mounted separately on the inserting device or corresponding mounting rails or stops.

As already mentioned, in the case of an inserting system being supplied from below, the packing pocket or the slats of the packing pocket are mounted inversely, that is to say with the flap guide downward. In this case, too, the flap guide plane K may be identical to the horizontal plane, and in this case the rib 33 projects downward from the horizontal plane or the surface of the packing pocket and at least in a partial region runs in manner inclined upward toward the rear.

Although individual aspects of the invention have been shown above in different exemplary embodiments, the individual aspects can readily be combined with one another within the scope of the routine knowledge of a person skilled in the art, provided that they do not rule one another out in a manner that is readily obvious to a person skilled in the art. Further embodiments will become apparent from the present disclosure and from the general knowledge of the person skilled in the art in respect of inserting and packing systems.

Envelopes having a flap that has already been opened can also be supplied. This provides the possibility of producing the envelopes inline, that is to say folding and gluing said envelopes beforehand from a paper web, and/or printing envelopes with an open flap, since in this way, with only one-sided printing, once the flap has been closed a portion of the rear side of the closed envelope (specifically the flap) has also been printed. In this case, the envelopes can be supplied to the system directly with an open flap, without the flap first having to be opened within the inserting system.

LIST OF REFERENCES

1 inserting system
2 envelope
3 envelope flap
4 flap fold
5 envelope contents
6 holder for empty envelopes
7 flap opener
8 transport elements
9 packing pocket
10 supply device
11 onward transport elements
12 funnel
13 flap guide, flap guide side
14 pulling means, pulling roller
15 mounting rail
16 synchronizing means
17 guide cam/cam lobe
18 angle profile
19 funnel base
20 transport roller
21 counter-roller
22 onward transport roller
23 further onward transport element, segment
25 opener claw
26 finger
27 cone
28 slat
28' outer slat
28" inner slat
29 outer side surface of the slat
30 sheet guide
31 adjusting means, adjusting spindle
32 supply drive
33 rib
34 auxiliary surface
35 adjustment rail
36 mounting stop
37 slat base
38 spring stop
53 front edge of packing pocket
l flap length
z maximum thickness of envelope contents
M mid-line
T, T" transport plane of the envelopes
K plane that includes the flap guide side
Wa onward transport angle
Wt, Wt" transport angle

What is claimed is:

1. A packing pocket (9) for an inserting system (1), wherein the packing pocket (9) comprises:

a plurality of slats (28) extending in a direction parallel to a mid-line M, the mid-line M corresponding to a transport direction of envelopes, each slat (28) including a flap guide (13) extending in a plane K, wherein at least one of the slats (28) is configured to be mounted on the inserting system (1), on a mounting rail (15), on an adjustment rail (35), or at least on a mounting stop, and a sheet guide (30) extending in a direction parallel to the mid-line M, wherein a first end of the sheet guide (30) is spaced from a first end of the plurality of slats (28) to define an opening for receiving envelope contents (5) and a second end of the sheet guide (3) is resiliently biased in contact with a distal end of the flap guide (13), characterized in that the at least one of the slats (28) configured to be mounted on the inserting system is designed to be mounted in such a way to the inserting system (1), that the at least one of the slats (28) does not have to be moved during an inserting operation, wherefore the first end of the sheet guide (30) is fixedly connected to the at least one of the slats (28), or to the mounting rail (15), or to the adjustment rail (35) or at least to one stop or to the inserting system (1).

2. The packing pocket according to claim 1, characterized in that the biasing of the sheet guide (30) to the flap guide (13) is adjusted such that a speed of supply of envelope contents (5) is maintained for envelope contents of different thickness.

3. The packing pocket according to a claim 1, characterized in that the sheet guide (30) is a spring.

4. The packing pocket according to claim 1, characterized in that the sheet guide (30) extends at an angle relative to the flap guide (13).

5. The packing pocket according to claim 1, characterized in that the second end of the sheet guide (30) touches an inner side of the flap guide (13) of the at least one of the slats (28).

6. The packing pocket according to claim 1, characterized in that the packing pocket (9) comprises a spring which biases the second end of the sheet guide (30) toward the distal end of the flap guide (13).

7. The packing pocket according to claim 1, characterized in that the slats (28) are mounted separately from one another and the packing pocket (9) has adjusting means (31) for displacing outer side slats (28'), which are on the outside relative to the mid-line M, in order to displace these in parallel to the mid-line M.

8. The packing pocket according to claim 7, characterized in that the adjusting means (31) comprise electrical and/or mechanical means.

9. The packing pocket according to claim 1, characterized in that at least one inner slat (28") is arranged in a stationary manner between outer slats (28').

10. The packing pocket according to claim 1, characterized in that outer slats (28') are at least partially closed on a respective outer side surface.

11. The packing pocket according to claim 1, characterized in that outer slats (28') form at least partially a U-shaped profile with an outwardly directed base, so that envelope contents (5) are guided on both sides of the packing pocket by the U-shaped profile.

12. The packing pocket according to claim 1, characterized in that at least one inner slat (28") is open on both side surfaces.

13. The packing pocket according to claim 1, characterized in that the flap guide (13) is mounted on the inserting system (1), on a mounting rail (15) or on an adjustment rail (35).

14. The packing pocket according to claim 1, characterized in that to at least outer slats (28') a sheet guide (30) is assigned, which is at a distance from the flap guide (13).

15. The packing pocket according to claim 1, characterized in that to at least one inner slat (28") a sheet guide (30) is assigned, which is at a distance from the flap guide (13).

16. The packing pocket according to claim 1, for an inserting system (1) for inserting the envelope contents (5) into an envelope (2), wherein the inserting system (1) comprises a holder (6) for empty envelopes, a flap opener (7) for opening an envelope flap (3) of the envelope (2), transport elements (8) for transporting the envelopes (2) from the holder (6) to the packing pocket (9) on which the envelopes (2) are filled, a supply device (10) for supplying the envelope contents (5) to the packing pocket and into the packing pocket (9), and onward transport elements (11) for the onward conveying of the filled envelope (2), and the inserting system (1) further comprises at least one of the following features: the mounting rail (15), the adjustment rail (35), the stop.

17. A method for filling a packing pocket according to claim 1, wherein an envelope (2) with an open envelope flap (3) in front is transported to the packing pocket (9) and the envelope contents (5) are supplied to the packing pocket (9) by means of a supply device (10), wherein the envelope (2) is filled and then onward transport elements (11) convey the filled envelope onward, whereby the envelope contents (5) are guided into the packing pocket (9) wherein the envelope contents (5) are spring-biased toward the flap guide (13) by the sheet guide (30), at least in a front region in relation to the envelope supply, characterized in that the envelope contents (5) do not touch the envelope (3) until in the region of a front edge (53) of the packing pocket and the at least one of the slats (28) is not moved during the inserting operation.

18. The method for filling a packing pocket according to claim 17, characterized in that the envelope contents (5) are biased at least by two sheet guides (30) which are assigned respectively to outer slats (28').

19. The method for filling a packing pocket according to claim 17, characterized in that the envelope contents (5) are biased at least by one sheet guide (30), which is assigned to an inner slat (28").

20. The method for filling a packing pocket according to claim 17, characterized in that the envelope contents (5) are additionally guided by at least partially closed outer side surfaces of outer slats (28').

* * * * *